US006628914B1

(12) United States Patent
Wang et al.

(10) Patent No.: US 6,628,914 B1
(45) **Date of Patent: *Sep. 30, 2003**

(54) SLIDING COVER DEVICE ARRANGEMENT FOR CONTROLLING TONER PASSAGE BETWEEN THE TONER CONTAINER AND DEVELOPING DEVICE OF AN IMAGE FORMING APPARATUS

(75) Inventors: Jui-Chi Wang, Taichung (TW); Robin Hsu, Taichung (TW); Ya Li Huang, Taichung (TW); Kuan Tung Li, Yunlin (TW); Shu Hui Wang, Taichung (TW); Smarla Hui Wang, Taichung County (TW); Ting Hsuan Ko, Taichung County (TW); Renhao Liu, Taichung (TW); Hui Wen Hsieh, Feng-Yuan (TW)

(73) Assignee: General Plastics Industrial Co., Ltd., Taichung County (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/171,037

(22) Filed: Jun. 11, 2002

(51) Int. Cl.[7] ..... G03G 15/08
(52) U.S. Cl. ..... 399/258; 399/260; 399/262
(58) Field of Search ..... 399/25, 105, 106, 399/111, 113, 258, 259, 260, 262; 222/DIG. 1; 141/346, 363, 364

(56) References Cited

U.S. PATENT DOCUMENTS 4,456,154 A * 6/1984 Herriman ..... 222/DIG. 1
4,615,364 A * 10/1986 Kawata ..... 222/DIG. 1
5,111,976 A * 5/1992 Ban ..... 222/DIG. 1
5,475,469 A * 12/1995 Okada et al. ..... 399/264
2003/0039484 A1 * 2/2003 Naito et al. ..... 399/113

FOREIGN PATENT DOCUMENTS

JP 08179611 A * 7/1996 ..... G03G/15/08

* cited by examiner

*Primary Examiner*—Susan S.Y. Lee
*Assistant Examiner*—Ryan Gleitz
(74) *Attorney, Agent, or Firm*—Merchant & Gould; Tim Tingkang Xia

(57) ABSTRACT

A sliding cover device arrangement for controlling toner passage between a toner container and a developing device of an image forming apparatus, wherein the developing device has a plurality of toner receiving openings formed thereon, and the toner container is adapted for holding toner and supplying toner to the developing device, and has a plurality of toner supplying openings formed thereon corresponding to the plurality of toner receiving openings. In one embodiment, the sliding cover arrangement includes a first sliding cover adapted for closing and opening the toner receiving openings, a second sliding cover adapted for closing and opening the toner supplying openings, and coupling means formed on the developing device and the toner container for enabling the first sliding cover and the second sliding cover to be moved to close and open the toner supplying openings and the toner receiving openings synchronously, the coupling means including projection means and recess means for engagement with the projection means.

13 Claims, 6 Drawing Sheets

SLIDING COVER DEVICE ARRANGEMENT FOR CONTROLLING TONER PASSAGE BETWEEN THE TONER CONTAINER AND DEVELOPING DEVICE OF AN IMAGE FORMING APPARATUS

BACKGROUND OF THE INVENTION

1. Field of the Invention

The present invention relates to a developer supply device and, more particularly to a sliding cover device arrangement for controlling toner passage between the toner container and developing device of an image forming apparatus, for example, an electrophotographic copying machine, an electrophotographic printer, an electrophotographic facsimile, an electrophotographic word processor, or the like.

2. Description of the Related Art

A regular process cartridge for an image forming apparatus is generally comprised of an electrophotographic photosensitive member, developing means, charging means, cleaning means, and a toner container. When the toner container is used up, the whole assemble of the process cartridge becomes useless and must be thrown away. It is not economical to throw the whole assembly of the process cartridge away after the process cartridge is emptied. Further, the waste process cartridge may cause pollution to the environment if it is not disposed of in a proper manner.

SUMMARY OF THE INVENTION

The present invention has been accomplished to eliminate the aforesaid drawbacks. In one aspect, the present invention relates to a sliding cover device arrangement for controlling toner passage between the toner container and the developing device of an image forming apparatus, which enables the user to replace the toner container without throwing the whole assembly of the process cartridge away when the toner of the toner container is depleted. In one embodiment of the present invention, the sliding cover device arrangement includes a developing device having a plurality of toner receiving openings and a first sliding cover adapted for closing and opening the toner receiving openings, a toner container having a plurality of toner supplying openings corresponding to the toner receiving openings and a second sliding cover adapted for closing and opening the toner supplying openings, and coupling means formed on the developing device and the toner device for enabling the first sliding cover and the second sliding cover to be moved to close and open the toner supplying openings and the toner receiving openings synchronously. The coupling means includes projection means and recess means for engagement with the projection means. According to another embodiment of the present invention, the projection means comprises a plurality of projections protruded from the second sliding cover of the toner container, each projection extended around a corresponding one of the plurality of openings of the second sliding cover and respectively engaged by the toner receiving openings of the developing device.

DETAILED DESCRIPTION OF THE PREFERRED EMBODIMENT

Figure 1:
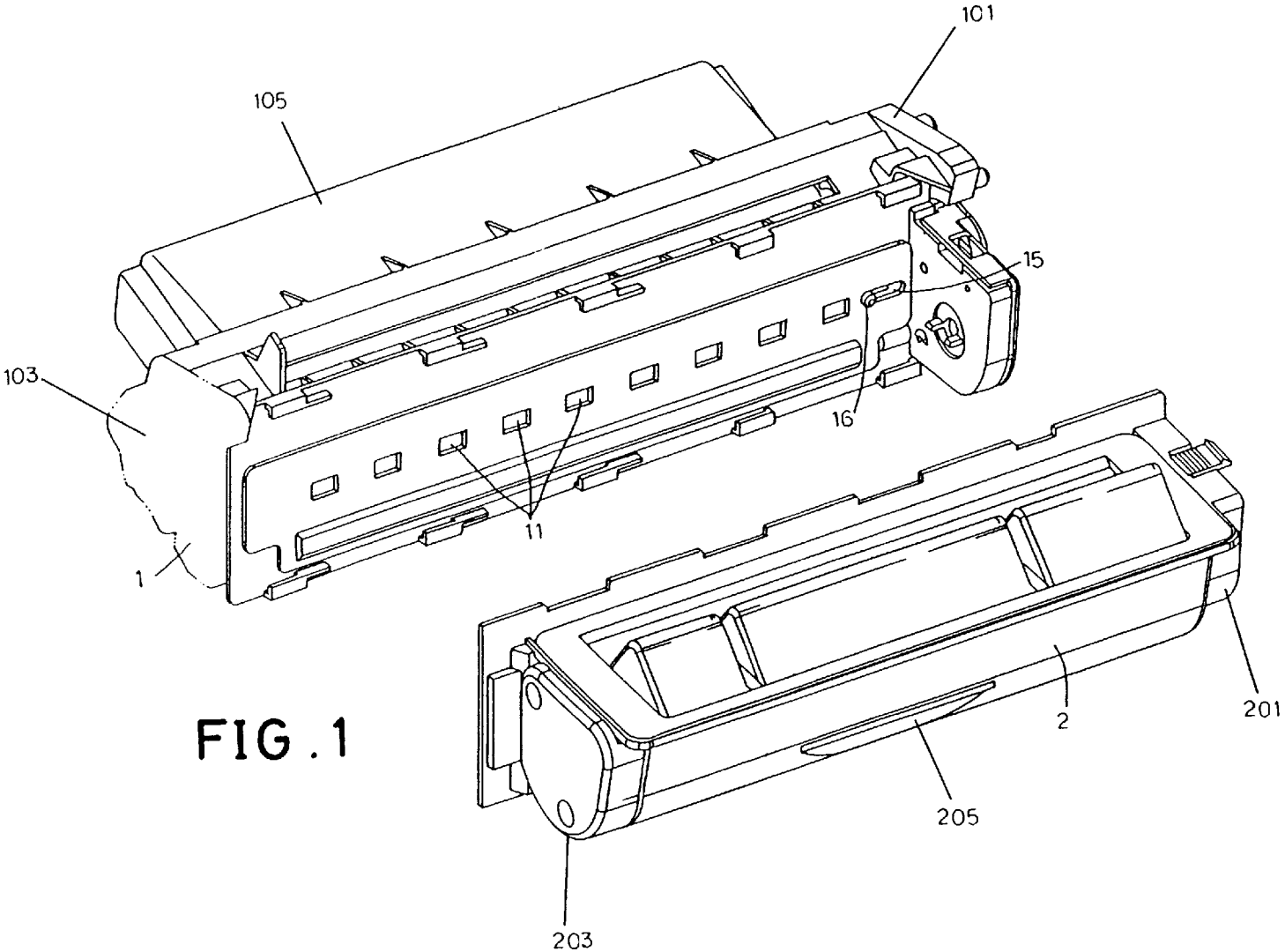
FIG. 1 is an exploded view of the preferred embodiment of the present invention.
Figure 2:
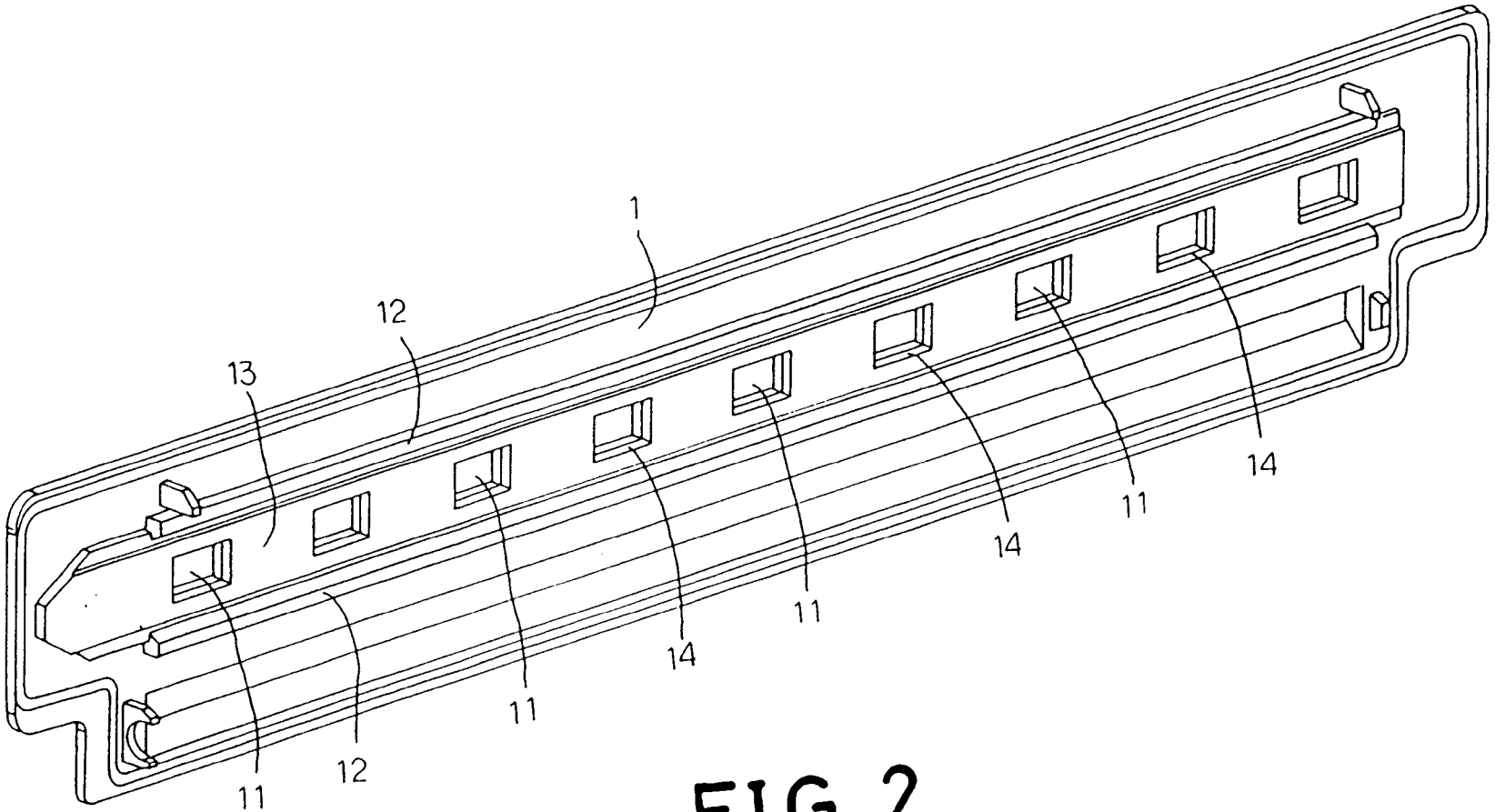
FIG. 2 is a back side view of the developing device, showing the first sliding cover moved to the open position and the toner receiving openings opened according to the present invention.

Referring to FIG. 1, a sliding cover device arrangement for controlling toner passage between the toner container and developing device of an image forming apparatus is shown comprised of a developing device 1 and a toner container 2.

Figure 3:
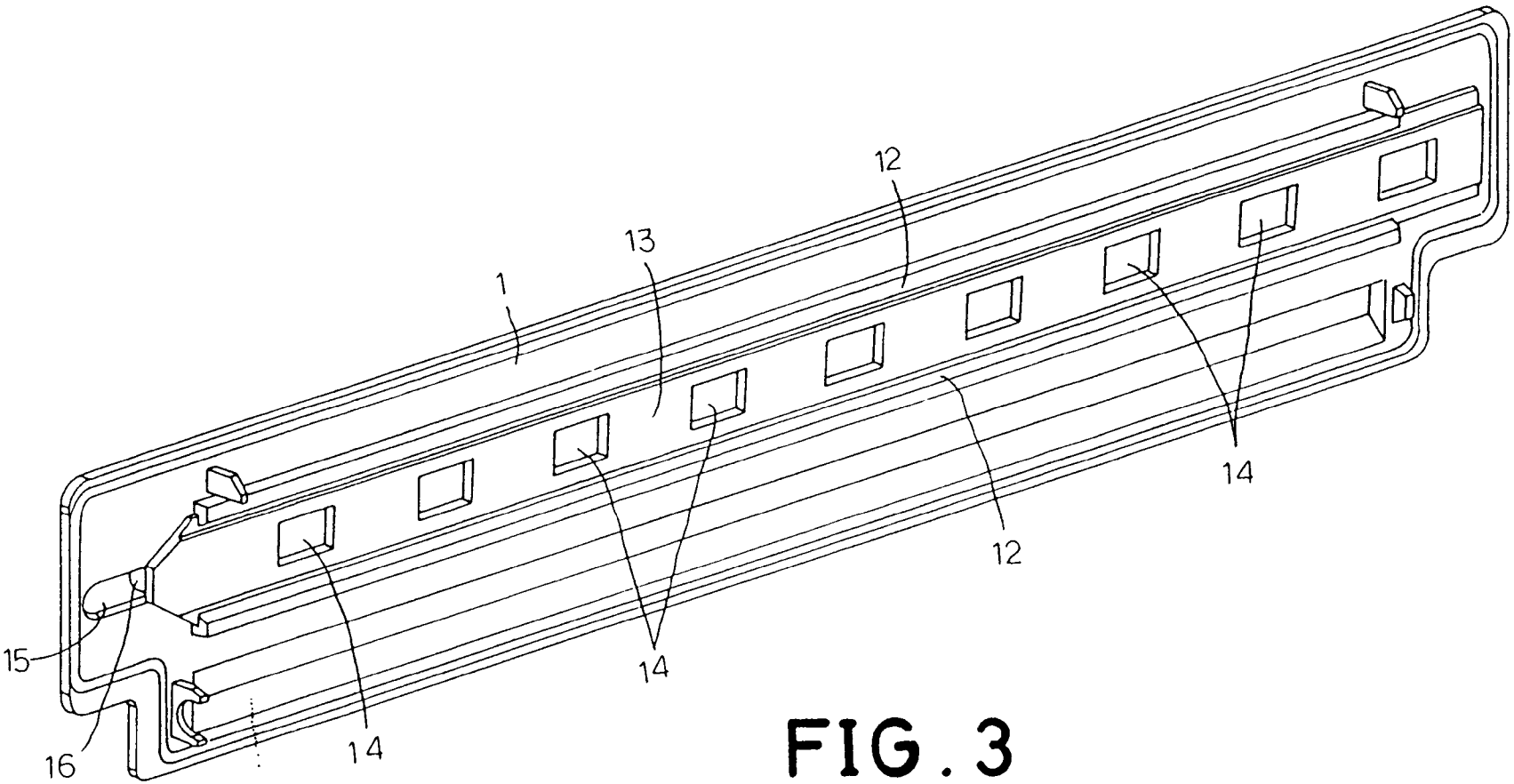
FIG. 3 is another back side view of the developing device, showing the first sliding cover moved to the close position and the toner receiving openings closed according to the present invention.

Referring to FIG. 3 and FIG. 1 again, the developing device 1 comprises a first end 101, an opposite second end 103, and a body 105 defined between the first end 101 and the opposite second end 103, wherein the body 105 has a plurality of toner receiving openings 11 formed thereon substantially along a longitudinal axis of the body 105 of the developing device 1, two elongated first guide members 12 arranged in parallel at different elevations above and below the toner receiving openings 11, and a first sliding cover 13 inserted between the first guide members 12 and moved to close and open the toner receiving openings 11. The first sliding cover 13 comprises a plurality of openings 14 corresponding to the toner receiving openings 11.

Referring to FIGS. 1 and 3 again, the developing device 1 further comprises a sliding slot 15 disposed in line with the toner receiving openings 11 at one end, and first projection means 16 protruded from one end of the first sliding cover 13. The first projection means 16 is a projection rod protruded from one end thereof and inserted through the sliding slot 15.

Referring to FIG. 1 again, the developing device 1 further comprises first recess means. According to the present preferred embodiment, the first recess means comprises the toner receiving openings 11.

Figure 4:
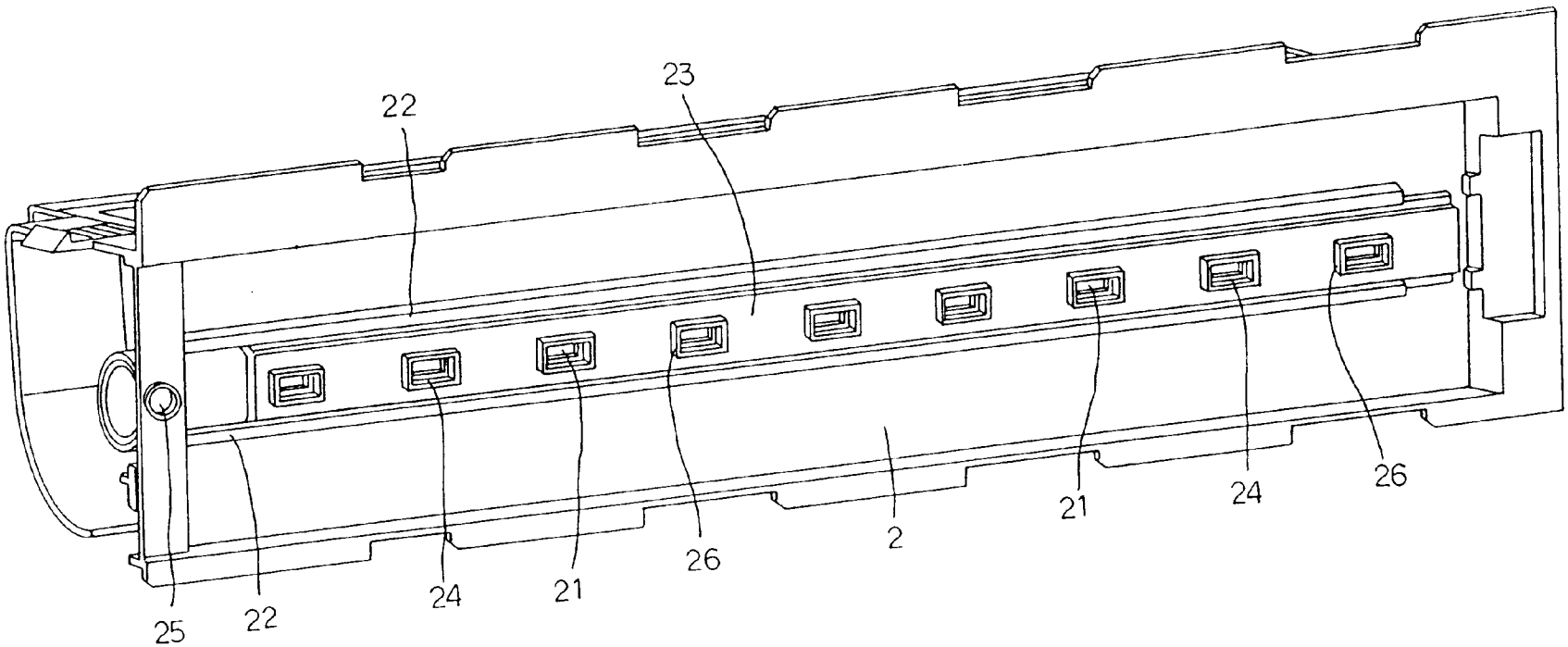
FIG. 4 is a back side view of the toner container, showing the second sliding cover moved to the opening position and the toner supplying openings opened according to the present invention.
Figure 5:
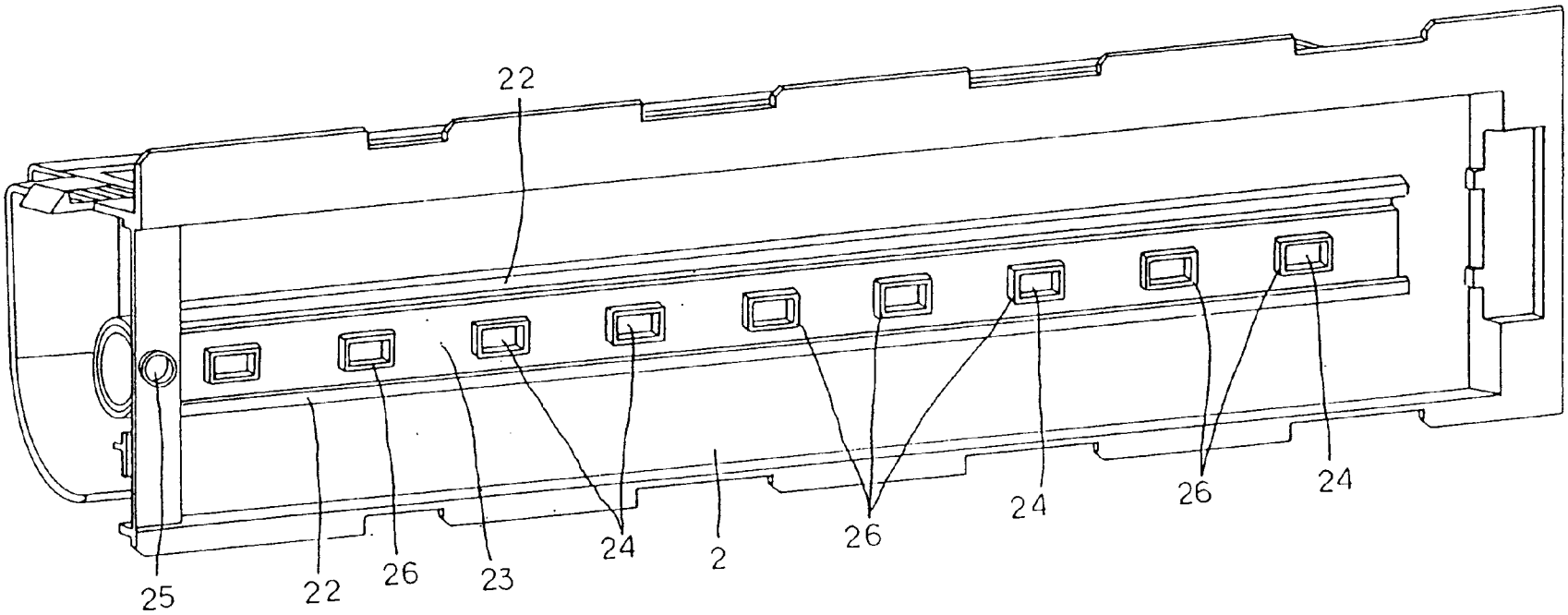
FIG. 5 is another back side view of the toner container, showing the second sliding cover moved to the close position and the toner supplying openings closed according to the present invention.

Referring to FIGS. 4 and 5 and FIG. 1 again, the toner container 2 comprises a first end 201, an opposite second end 203, and a body 205 defined between the first end 201 and the opposite second end 203, wherein the body 205 has a plurality of toner supplying openings 21 formed thereon substantially along a longitudinal axis of the body 205 of the toner container 2 corresponding to the toner receiving openings 11 of the developing device 1, two elongated second guide members 22 arranged in parallel at different elevations above and below the toner supplying openings 21, and a second sliding cover 23 inserted between the second guide members 22 and moved to close and open the toner supplying openings 21. The second sliding cover 23 comprises a plurality of openings 24 corresponding to the toner supplying openings 21.

Referring to FIGS. 4 and 5 again, the toner container 2 further comprises second recess means 25 corresponding to first projection means 16. According to the present preferred embodiment, the second recess means 25 is a retaining hole, which receives the first projection means 16. The toner container 2 further comprises second projection means 26. According to the present preferred embodiments, the second projection means 26 comprises a plurality of projections respectively extended around each of the openings 24 of the second sliding cover 23.

Figure 6:
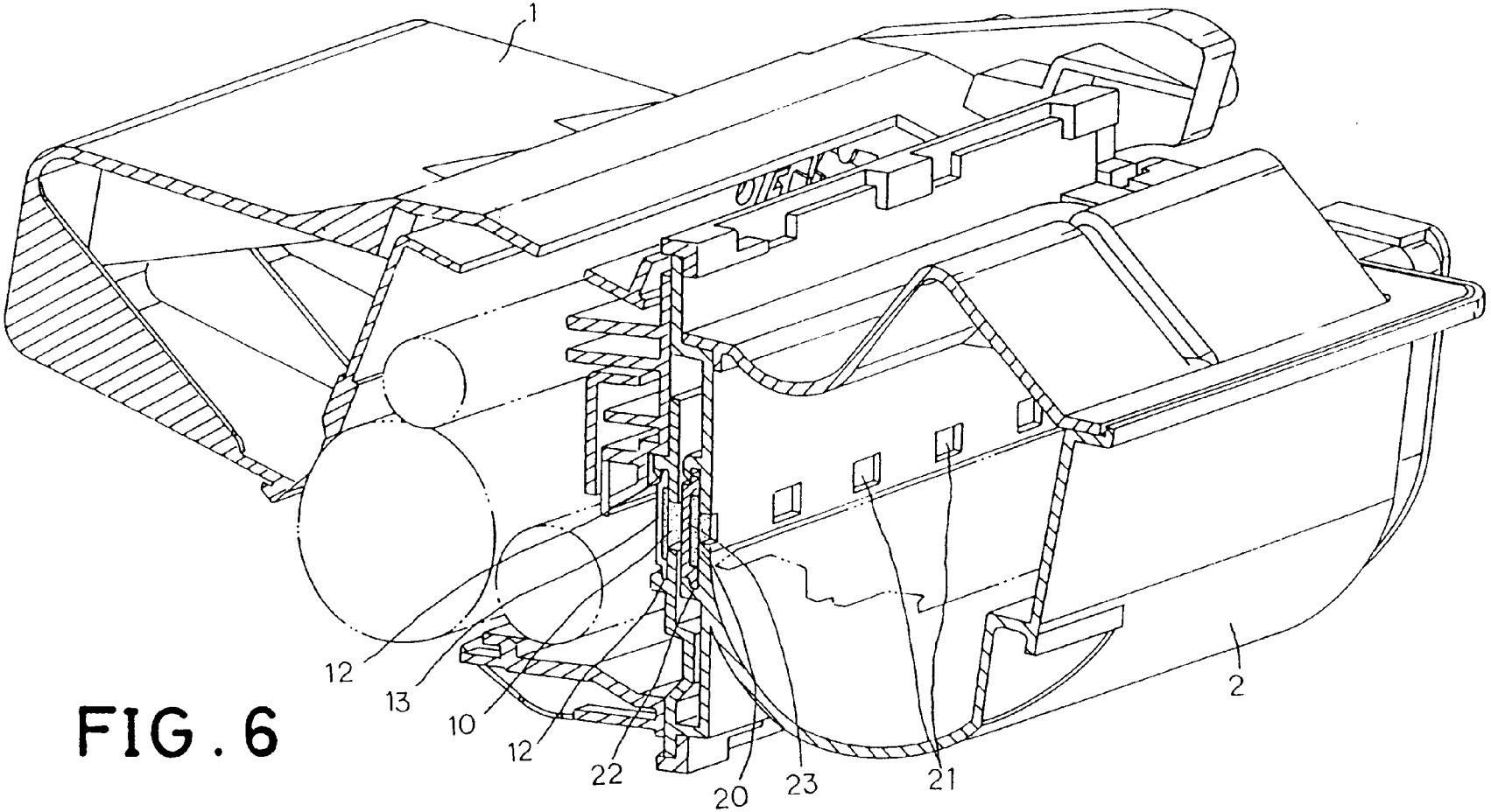
FIG. 6 is a sectional elevation of the preferred embodiment of the present invention, showing the toner container coupled to the developing device.

Referring to FIG. 6 and FIG. 1 again, when the toner container 2 is to be mounted on the developing device 1 at a predetermined position, the first projection means 16 of the developing device 1 is positioned in the first predetermined position and received in the second recess means 25 so as to engage with the toner container 2, and the projections 26 of the second sliding cover 23 of the toner container 2 are, respectively, engaged into the toner receiving openings 11 of the developing device 1. When the toner container 2 is shifted to be mounted on the developing device 1 at the predetermined position, the shifting movement of the toner container causes the first projection means 16 to move by the engagement between the first projection means 16 and the second recess means 25 from the first predetermined position to the second predetermined position, and the movement of the first projection means 16 causes the first sliding cover 13 and the second sliding cover 23 to shift in between the respective guide members 12 and 22 in a direction with the toner container 2 to force the plurality of openings 14 of the first sliding cover 13 into alignment with the toner receiving openings 11, respectively. At this time, the toner supplying openings 21 of the toner container 2 are respectively positioned at the toner receiving openings 11 of the developing device 1 for the passing of toner from the toner container 2 to the developing device 1.

On the contrary, when the toner container 2 is shifted in the reverse[d] direction, for example, to be dismounted from the developing device 1, the shifting movement of the toner container causes the first projection means 16 to move by the engagement between the first projection means 16 and the second recess means 25 from the second predetermined position to the first predetermined position, and the movement of the first projection means 16 causes the first sliding cover 13 of the developing device 1 and the second sliding cover 23 of the toner container 2 to shift in the reverse direction with the toner container 2, thereby causing the first sliding cover 13 and the second sliding cover 23 to close the toner receiving openings 11 and the toner supplying openings 21, convenient for replacing the toner container 2 with a new one.

Referring to FIG. 6 again, sponge linings 10 and 20 are, respectively, installed in between the developing device 1 and the first sliding cover 13 around the toner receiving openings 11 and in between the toner container 2 and the second sliding cover 23 around the toner supplying openings 21 to prevent leakage of the toner during toner supplying operation.

A prototype of sliding cover device arrangement for controlling toner passage between the toner container and developing device of an image forming apparatus has been constructed with the features of FIGS. 1~6. The sliding cover device arrangement for controlling toner passage between the toner container and developing device of an image forming apparatus functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A sliding cover device arrangement for controlling toner passage between a toner container and a developing device of an image forming apparatus, wherein the developing device comprises a first end, an opposite second end, and a body defined between the first end and the opposite second end, wherein the body has a plurality of toner receiving openings formed thereon substantially along a longitudinal axis of the body of the developing device, and the toner container is adapted for holding toner and supplying toner to the developing device, the toner container comprising a first end, an opposite second end, and a body defined between the first end and the opposite second end, wherein the body has a plurality of toner supplying openings formed thereon substantially along a longitudinal axis of the body of the toner container corresponding to the plurality of toner receiving openings, comprising:

a first sliding cover movable along the longitudinal axis of the body of the developing device and adapted for closing and opening the plurality of toner receiving openings of developing device;

a second sliding cover movable along the longitudinal axis of the body of the toner container and adapted for closing and opening the toner supplying openings of said toner container; and coupling means formed on the developing device and the toner container for enabling the first sliding cover and the second sliding cover to be moved synchronously along one of the longitudinal axis of the body of the developing device and the longitudinal axis of the body of the toner container to close and open the toner supplying openings and the toner receiving openings, respectively, the coupling means comprising projection means and recess means adapted for receiving the projection means.

2. The sliding cover device arrangement as claimed in claim 1, wherein said projection means of the coupling means comprises a first projecting rod protruded from one end of the first sliding cover of the developing device and adapted for engaging said recess means of the coupling means.

3. The sliding cover device arrangement as claimed in claim 2, wherein the recess means of the coupling means comprises a retaining hole disposed on the toner container near one side of the toner supplying opening and adapted for receiving the first projecting rod.

4. The sliding cover device arrangement as claimed in claim 1, wherein the second sliding cover comprises a plurality of openings adapted for guiding toner from the toner supplying opening of the toner container to the toner receiving openings of the developing device.

5. The sliding cover device arrangement as claimed in claim 2, wherein the recess means of said coupling means further comprises a sliding slot formed on the developing device in line with the plurality of toner receiving openings formed thereon and adapted for receiving said first projection rod of the developing device.

6. The sliding cover device arrangement as claimed in claim 1, wherein the developing device comprises two guide members arranged in parallel at different elevations above and below said toner receiving openings and adapted for guiding movement of the first sliding cover to close and open the toner receiving openings.

7. The sliding cover device arrangement as claimed in claim 1, wherein the first sliding cover comprises a plurality of openings corresponding to the toner receiving openings of the developing device.

8. The sliding cover device arrangement as claimed in claim 1, wherein the toner container comprises two guide members arranged in parallel at different elevations above and below the toner receiving openings and adapted for guiding movement of the second sliding cover to close and open the toner supply openings.

9. The sliding cover device arrangement for controlling toner passage between the toner container and developing device of an image forming apparatus as claimed in claim 1, further comprising a sponge lining fixedly provided between one side of said developing device and said first sliding cover around said toner receiving openings.

10. The sliding cover device arrangement for controlling toner passage between the toner container and developing device of an image forming apparatus as claimed in claim 1, further comprising a sponge lining fixedly provided between one side of said toner container and said second siding cover around said toner supplying openings.

11. The sliding cover device arrangement as claimed in claim 1, wherein the toner receiving openings form a part of the recess means for engagement with the projection means.

12. The sliding cover device arrangement as claimed in claim 11, wherein the projection means comprises a plurality of projections protruded from the second sliding cover, each projection extended around a corresponding one of the plurality of openings of the second sliding cover and adapted for engaging the toner receiving openings.

13. The sliding cover arrangement as claimed in claim 1, wherein the second sliding cover comprises a plurality of openings corresponding to the toner supply openings.

* * * * *